US007696976B2

(12) United States Patent
Choi

(10) Patent No.: US 7,696,976 B2
(45) Date of Patent: Apr. 13, 2010

(54) DATA DRIVER AND ORGANIC LIGHT EMITTING DISPLAY DEVICE HAVING THE SAME

(75) Inventor: Sang-Moo Choi, Suwon-si (KR)

(73) Assignee: Samsung Mobile Display Co., Ltd., Yongin, Gyunggi-do (KR)

( * ) Notice: Subject to any disclaimer, the term of this patent is extended or adjusted under 35 U.S.C. 154(b) by 770 days.

(21) Appl. No.: 11/522,190

(22) Filed: Sep. 15, 2006

(65) Prior Publication Data

US 2007/0057836 A1 Mar. 15, 2007

(30) Foreign Application Priority Data

Sep. 15, 2005 (KR) ..... 10-2005-0086371

(51) Int. Cl.
*G09G 3/36* (2006.01)

(52) U.S. Cl. ..... 345/100; 345/76; 377/64

(58) Field of Classification Search ..... 345/76–83, 345/98, 100, 211; 377/57–81
See application file for complete search history.

(56) References Cited

U.S. PATENT DOCUMENTS

2003/0218594 A1* 11/2003 Ishii ..... 345/96
2005/0168416 A1* 8/2005 Hashimoto et al. ..... 345/76
2007/0018918 A1* 1/2007 Chung ..... 345/76

* cited by examiner

*Primary Examiner*—Amare Mengistu
*Assistant Examiner*—Dmitriy Bolotin
(74) *Attorney, Agent, or Firm*—Knobbe Martens Olson & Bear LLP

(57) ABSTRACT

An organic light emitting display device having a sampling voltage supplying unit is disclosed. The sampling voltage supplying unit supplies a power supply voltage to a plurality of sampling latches in common depending on an output signal of a shift register. Accordingly, it is possible to significantly reduce the number of transistors in the sampling latches and reduce panel area occupied by the data driver. The reduced number of transistors of the sampling latches also reduces power consumption.

21 Claims, 7 Drawing Sheets

DATA DRIVER AND ORGANIC LIGHT EMITTING DISPLAY DEVICE HAVING THE SAME

CROSS-REFERENCE TO RELATED APPLICATION

This application claims priority to and the benefit of Korean Patent Application No. 2005-86371, filed Sep. 15, 2005, which is incorporated herein by reference in its entirety.

BACKGROUND OF THE INVENTION

1. Field of the Invention

The present invention relates to an organic light emitting display device, and more particularly, to an organic light emitting display device having a sampling voltage supplying unit that supplies common power supply signals to sampling latches of a data driver.

2. Description of the Related Technology

In recent years, flat panel display devices that can substitute for cathode ray tubes (CRTs) have been actively studied. In particular, owing to excellent luminance and viewing angle characteristics, organic light emitting display devices are attracting much attention as the next-generation flat panel display devices.

The organic light emitting display devices need no light source and use light emitting diodes that emit specific light, unlike liquid crystal display devices. The light emitting diodes emit light corresponding to the amount of driving current flowing into an anode electrode.

FIG. 1 is a block diagram of a conventional organic light emitting display device.

The organic light emitting display device includes a pixel portion 10, a scan driver 20, a data driver 30, and an emission control driver 40.

The pixel portion 10 includes a plurality of pixels P11 to Pnm at intersections of a plurality of scan lines S1 to Sn, a plurality of data lines D1 to Dm, and a plurality of emission control lines E1 to En, and displays given images according to an applied data voltage.

One unit pixel Pnm includes red, green and blue sub-pixels.

The red, green and blue sub-pixels in the pixel portion 10 have the same pixel circuit configuration and emit red, green and blue light corresponding to current applied to respective organic light emitting elements. The pixel Pnm combines light emitted by the red, green and blue sub-pixels, and displays a color corresponding to the combination.

The scan driver 20 sequentially supplies a scan signal to the scan lines S1 to Sn in response to scan control signals, i.e., a start pulse and a clock signal from a timing controller (not shown).

The emission control driver 40 includes a shift register and the like, and sequentially supplies an emission control signal to the emission control lines E1 to En in response to the start pulse and the clock signal from the timing controller.

The data driver 30 supplies a data voltage corresponding to R, G, B data to the data lines D1 to Dm in response to a data control signal from the timing controller.

FIG. 2 is a block diagram of a data driver for a conventional organic light emitting display device.

Referring to FIG. 2, in the conventional organic light emitting display device, a data driver 30 includes a shift register 31, a plurality of sampling latches 32, a plurality of holding latches 33, and a plurality of digital/analog converters 34.

The shift register 31 has m number outputs, and receives a control signal Dg from a timing controller to sequentially supply an output signal. One output signal of the shift register 31 is supplied in common to n number of sampling latches 32, which constitute one data driving circuit.

The sampling latches 32 receive a digital image signal (R, G and B data) from the timing controller and sample the digital image signal into one-bit data. When one analog data signal represents 64 gradations, six (n=6) sampling latches 32 constitute one data driving circuit. These six sampling latches 32 receive the digital image signals (R, G and B data) from the timing controller and simultaneously receive one output signal from the shift register 31. Each sampling latch 32 samples the digital image signal by one-bit data in response to the applied output signal of the shift register 31.

The holding latches 33 receive and store the sampled one-bit data from each sampling latch 32, and supply the stored one-bit data to the digital/analog converter 34 in response to a holding control signal EN of the timing controller.

When one data driving circuit includes six sampling latches 32, six holding latches 33 are also provided. The holding control signal EN supplied from the timing controller is simultaneously supplied to the 6 holding latches 33. After each of the m number of output signals from the shift register 31 are supplied to the sampling latches 32, the holding control signal EN from the timing controller is supplied to the holding latches 33.

The digital/analog converter 34 receives the stored data from the six holding latches 33, converts the stored data to an analog voltage value corresponding to gradations represented by 6-bit data, and outputs the analog data signal to the data line Dm.

In the data driver 30 described above, one output signal from the shift register 31 is supplied to the six sampling latches 32 in common. Each sampling latch 32 includes a switching unit for connecting or disconnecting a power supply voltage with a latch unit in response to the output signal of the shift register 31. This increases the area occupied by each sampling latch 32 and, and in turn, reduces the area occupied by the pixel portion 10 in a panel.

SUMMARY OF CERTAIN INVENTIVE ASPECTS

The present invention provides a data driver having a sampling voltage supplying unit that supplies a common power supply voltage to sampling latches in response to an output signal of a shift register, and an organic light emitting display device having the same.

One embodiment is a data driver including a shift register configured to receive a start pulse and to sequentially generate output and inverted output signals in synchronization with a clock signal, a plurality of sampling latches configured to receive a digital image signal and to sample the received digital image signal, a plurality of holding latches configured to receive and to store the sampled digital image signal, a digital/analog converter configured to receive the stored digital image signal from the plurality of holding latches and to convert the stored digital image signal into an analog data signal, and a sampling voltage supplying unit configured to receive the output signal and the inverted output signal of the shift register, to generate a sampling voltage, and to supply the sampling voltage to each of the plurality of sampling latches.

Another embodiment is a organic light emitting display device including a pixel portion configured to display an image, a scan driver configured to supply a scan signal to the pixel portion, a data driver configured to supply a data signal to the pixel portion, and a timing controller configured to supply a control signal and a digital image signal to the scan driver and the data driver. The data driver includes a shift register configured to receive a start pulse and to sequentially generate output and inverted output signals in synchronization with a clock signal, a plurality of sampling latches configured to receive a digital image signal and to sample the received digital image signal, a plurality of holding latches configured to receive and to store the sampled digital image signal, a digital/analog converter configured to receive the stored digital image signal from the plurality of holding latches and to convert the stored digital image signal into an analog data signal, and a sampling voltage supplying unit configured to receive the output signal and the inverted output signal of the shift register, to generate a sampling voltage, and to supply the sampling voltage to each of the plurality of sampling latches.

BRIEF DESCRIPTION OF THE DRAWINGS

The above and other features of the present invention will be described in reference to certain embodiments with reference to the attached drawings in which.

DETAILED DESCRIPTION OF CERTAIN INVENTIVE EMBODIMENTS

Figure 1:
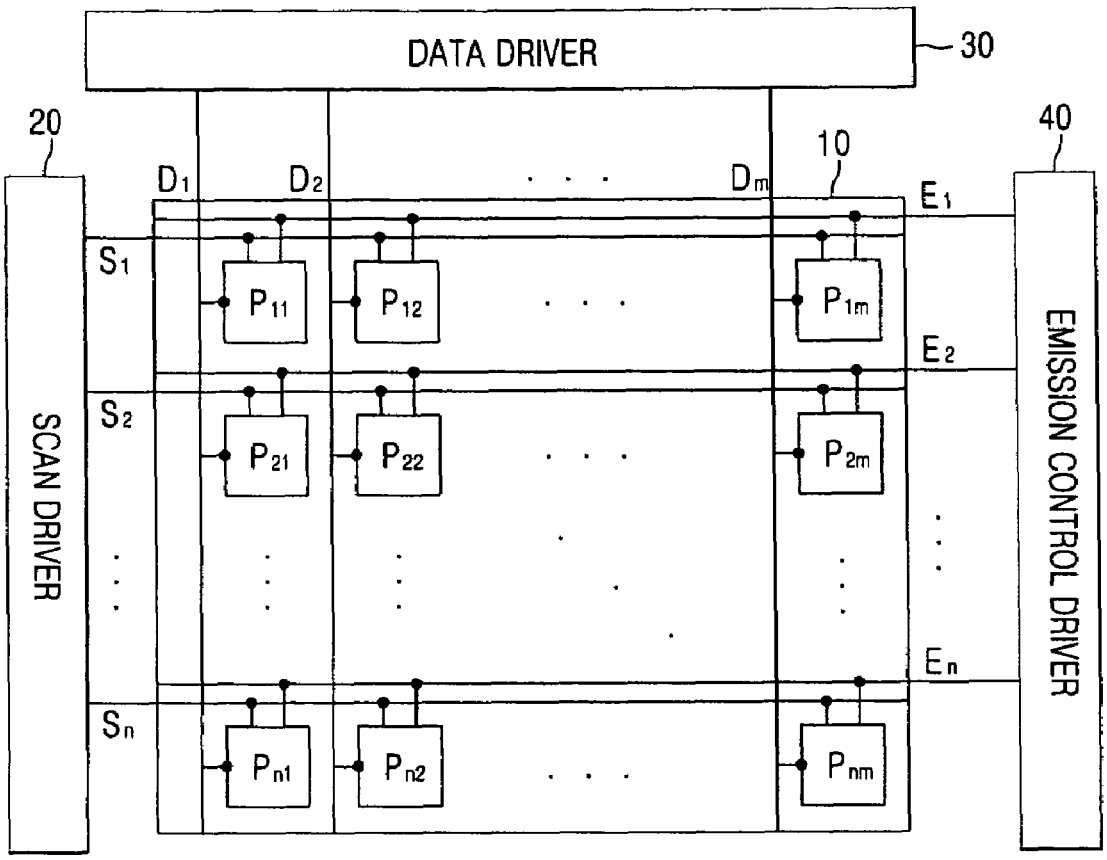
FIG. 1 is a block diagram of a conventional organic light emitting display device.
Figure 2:
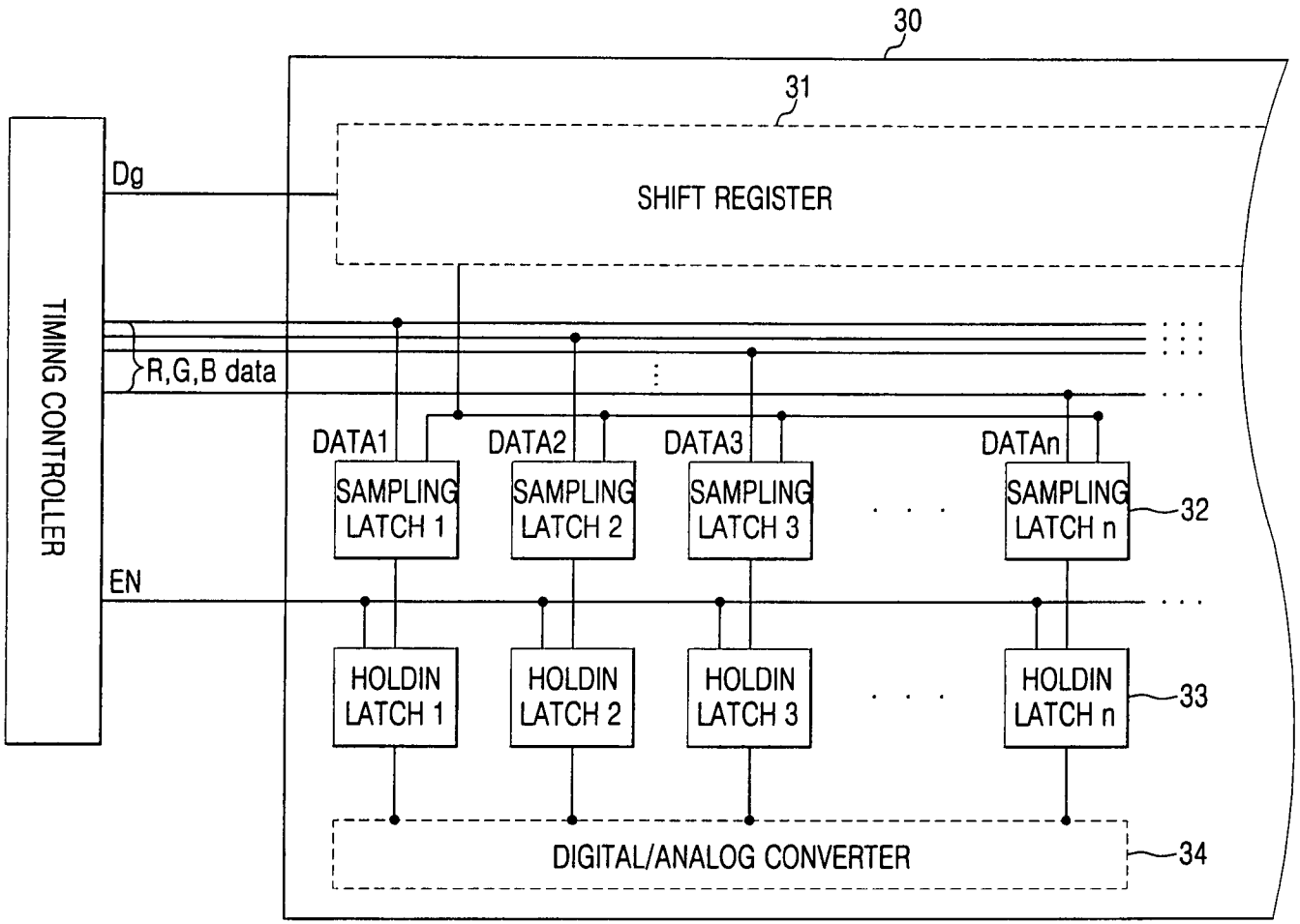
FIG. 2 is a block diagram of a data driver for a conventional organic light emitting display device.
Figure 3:
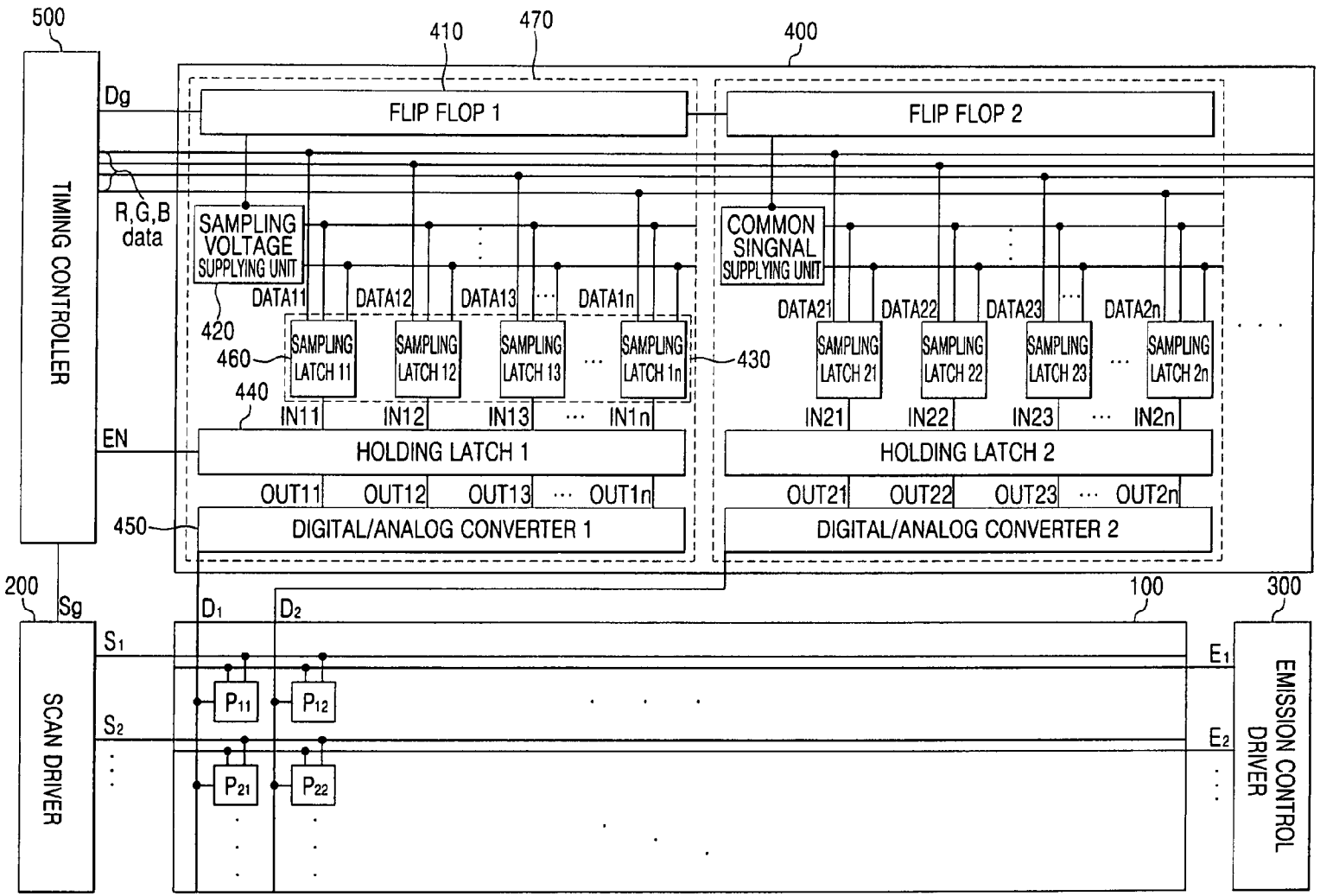
FIG. 3 is a block diagram of an organic light emitting display device according to an embodiment.

FIG. 3 is a block diagram of an organic light emitting display device according to one embodiment.

Referring to FIG. 3, the organic light emitting display device includes a pixel portion 100, a scan driver 200, an emission control driver 300, a data driver 400, and a timing controller 500.

The pixel portion 100 includes a plurality of pixels P11 to Pnm located in regions defined by a plurality of scan lines S1 to Sn, a plurality of emission control lines E1 to En, and a plurality of data lines D1 to Dm. Each pixel Pnm includes a red, a green and a blue sub-pixel, which receive each data signal from the data driver 400.

The red, green and blue sub-pixels of the pixel Pnm have the same pixel circuit configuration. The red, green and blue sub-pixels emit red, green and blue light corresponding to a current applied to an organic light emitting diode (OLED), respectively. The pixel Pnm combines the light emitted by the red, green and blue sub-pixels of the pixel Pnm to display a color corresponding to the combination.

The scan driver 200 sequentially supplies a scan signal to the plurality of scan lines S1 to Sn in synchronization with a scan control signal Sg, e.g., a start pulse, and a clock signal supplied from the timing controller 500.

The emission control driver 300 may include a shift register that outputs an emission control signal in synchronization with the control signals, e.g., the start pulse and the clock signals supplied from the timing controller 500. Alternatively, the emission control signal can be obtained by performing a logical operation on an output signal of the shift register or scan signals output from the scan driver 200. In this case, the emission control driver 300 is not separately provided.

The data driver 400 receives R, G and B digital image signals (R, G and B data) and a control signal Dg from the timing controller 500. The data driver 400 includes a plurality of data driving circuits 470 that supply a data signal to the respective data lines D1 to Dm.

The timing controller 500 receives control signals such as a horizontal synchronization signal and a vertical synchronization signal to supply the control signal Sg such as the clock signal and the start pulse to the scan driver 200 and the R, G and B digital image signals (R, G and B data) and the control signals Dg and EN to the data driver 400.

The data driver 400 supplying the data signal to m number of data lines D1 to Dm includes m number of data driving circuits 470. Each data driving circuit 470 includes a flip flop 410, a sampling voltage supplying unit 420, a sampling latch unit 430, a holding latch unit 440, and a digital/analog converter 450.

The first data driving circuit 470 supplies a data signal to the data line D1. The first data driving circuit 470 includes a flip flop 410 for receiving a clock signal and a start pulse Dg from the timing controller 500 to generate an output signal. The output signal of the flip flop 410 is input to a second flip flop in a second data driving circuit. In the second data driving circuit, the flip flop generates a one-cycle shifted output signal according to the clock signal applied from the timing controller 500. As a result, the flip flops 410 of the respective data driving circuits 470 constitute a shift register outputting output signals that are continuously shifted by one clock cycle.

The sampling voltage supplying unit 420 receives the output signal of the flip flop 410 to supply a positive voltage and a negative voltage to the plurality of sampling latches 460 in common. Accordingly, connections for commonly supplying the positive and negative voltages to the plurality of sampling latches 460 are formed from the sampling voltage supplying unit 420 to the sampling latch unit 430. These connections couple with the respective sampling latches 460 to transmit the positive voltage or the negative voltage in common.

The sampling latch unit 430 includes a plurality of sampling latches 460 for receiving digital image signals (R, G and B data) from the timing controller 500 and the positive and negative voltages from the sampling voltage supplying unit 420 to sample the digital image signals (R, G and B data) by one bit. When one data driving circuit 470 provides a data signal representing 64 gradations, six sampling latches 460 are provided. Further, in the case where each data driving circuit 470 provides a data signal to k data lines during one horizontal period using a demultiplexer, k×6 sampling latches 460 are included.

The holding latch unit 440 includes a plurality of holding latches that receive the one-bit digital image signal sampled by the sampling latch unit 430 and a holding control signal EN from the timing controller 500 to simultaneously transmit the signals to the digital/analog converter 450. When there are six sampling latches 460, one data driving circuit 470 has six holding latches receiving the one-bit digital image signal sampled from each sampling latch 460. The holding control signal EN provided from the timing controller 500 is simultaneously supplied to m×6 holding latches of the m number of data driving circuits 470. When the sampling operation of the sampling latches 430 in the m number of data driving circuits 470 is completed, the holding control signal EN is supplied from the timing controller 500 to the holding latches.

The holding latch unit 440 outputs the sampled one-bit digital image signal to the digital/analog converter 450 in synchronization with the holding control signal EN from the timing controller 500, and stores the digital image signal for a next horizontal synchronization period.

Figure 4:
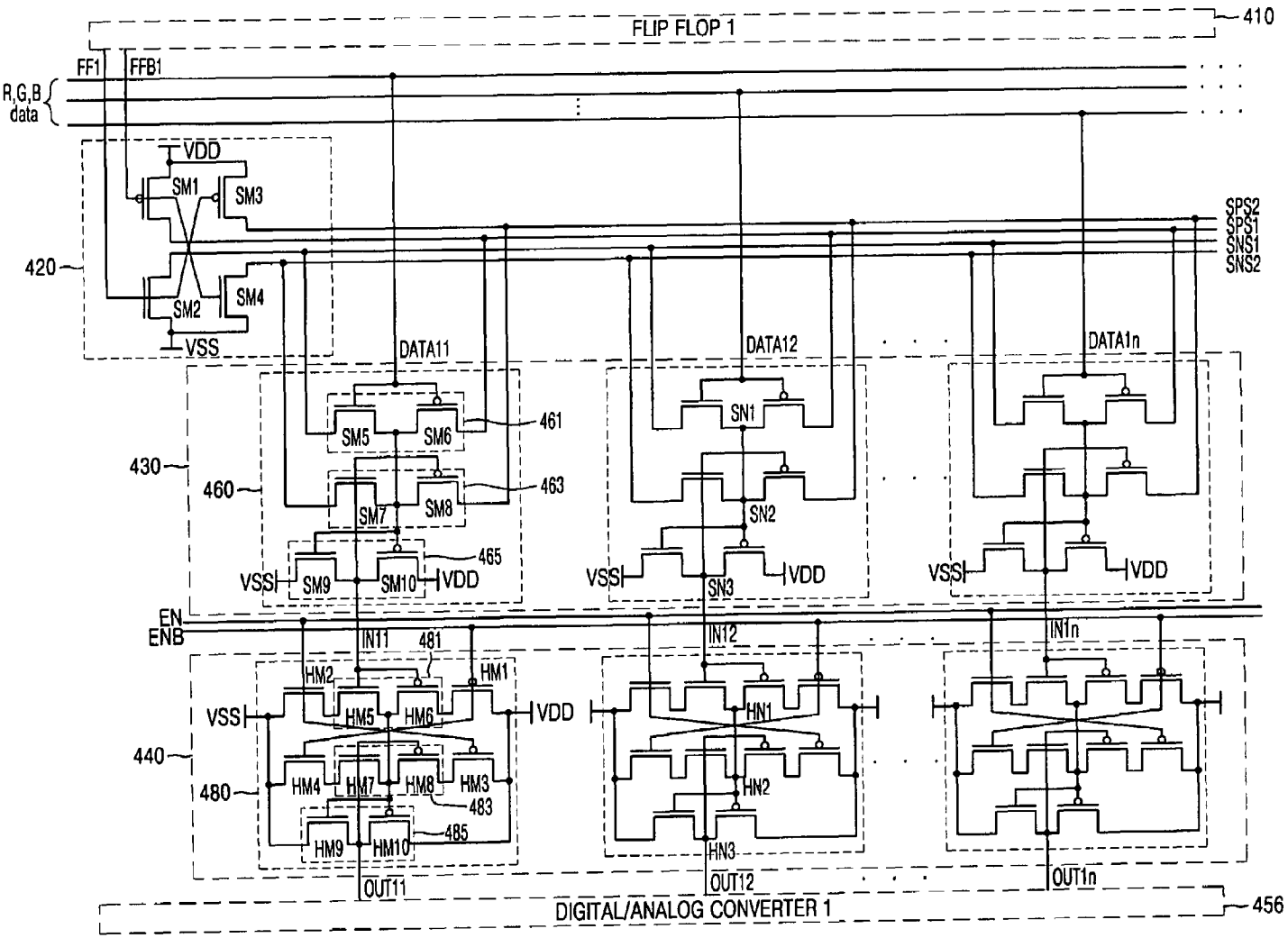
FIG. 4 is a circuit diagram of a data driver according to an embodiment.

FIG. 4 is a circuit diagram of a data driver according to an embodiment of the present invention.

Referring to FIG. 4, the data driver comprises a plurality of data driving circuits each including a flip flop 410, a sampling voltage supplying unit 420, a sampling latch unit 430, a holding latch unit 440, and a digital/analog converter 450.

A first data driving circuit that supplies a data signal to a first data line will now be described with reference to FIG. 4.

The flip flop 410 receives a clock signal and a start pulse from the timing controller 500 to supply an output signal FF1 and an inverted output signals FFB1 to the sampling voltage supplying unit 420.

The sampling voltage supplying unit 420 includes four transistors SM1, SM2, SM3 and SM4.

The first transistor SM1 is connected to a positive power supply voltage VDD, and turned on/off in response to the inverted output signal FFB1 of the flip flop to supply a first positive voltage SPS1 to the plurality of sampling latches 460.

The second transistor SM2 is connected to a negative power supply voltage VSS, and turned on/off in response to the output signal FF1 of the flip flop to supply a first negative voltage SNS1 to the plurality of sampling latches 460.

The third transistor SM3 is connected to the positive power supply voltage VDD, and turned on/off in response to the output signal FF1 of the flip flop to supply a second positive voltage SPS2 to the plurality of sampling latches 460.

The fourth transistor SM4 is connected to the negative power supply voltage VSS, and turned on/off in response to the inverted output signal FFB1 of the flip flop to supply a second negative voltage SNS2 to the plurality of sampling latches 460.

The first and third transistors SM1 and SM3 are P-type metal oxide semiconductor field effect transistors (hereinafter referred to as MOSFETs), and the second and fourth transistors SM2 and SM4 are N-type MOSFETs. In other embodiments, the first and third transistors SM1 and SM3 are designed as N-type transistors and the second and fourth transistors SM2 and SM4 are designed as P-type transistors according to the level of the output signal FF1.

As described above, the four transistors SM1, SM2, SM3 and SM4 supply the first positive voltage SPS1, the first negative voltage SNS1, the second positive voltage SPS2, and the second negative voltage SNS2 through metal lines connected to the plurality of sampling latches 460.

The plurality of sampling latches 460 each have the same configuration and receive the positive and negative voltages SPS and SNS from the sampling voltage supplying unit 420 in common.

When six sampling latches 460 are used in one data driving circuit, six (n=6) data transmission lines transmitting the digital image signal from the timing controller 500 are used for a plurality of data driving circuits. Each of these data transmission lines transmits data corresponding to the same bit-place in six-bit data representing 64 gradations. Thus, each of the six sampling latches 460 in one data driving circuit receives digital image signals from a different data transmission lines.

The sampling latch 460 includes three inverters 461, 463 and 465. Each of the inverters 461, 463 and 465 includes one N-type MOSFET and a P-type MOSFET. In the inverters 461, 463 and 465, a positive voltage is connected to the P-type MOSFET and a negative voltage is connected to the N-type MOSFET, such that a positive voltage or a negative voltage is input depending on the level of an input signal applied to the two transistors in common.

The first inverter 461 includes two transistors SM5 and SM6 connected in series. The first negative voltage SNS1 is supplied to the N-type transistor SM5 and the first positive voltage SPS1 is supplied to the P-type transistor SM6. The digital image signal is supplied to gates of the two transistors SM5 and SM6 through the data transmission line. The first inverter 461 outputs the first positive voltage SPS1 or the first negative voltage SNS1 depending on the level of the applied digital image signal.

The second inverter 465 includes two transistors SM9 and SM10 connected in series. The negative power supply voltage VSS is supplied to the N-type transistor SM9, and the positive power supply voltage VDD is supplied to the P-type transistor SM10. The output signal of the first inverter 461 is supplied to gates of the two transistors SM9 and SM10. The second inverter 465 outputs the positive power supply voltage VDD or the negative power supply voltage VSS to an input IN11 of the holding latch 480 depending on the level of the output signal of the first inverter 461.

The third inverter 463 includes two transistors SM7 and SM8 connected in series. The second negative voltage SNS2 is supplied to the N-type transistor SM7, and the second positive voltage SPS2 is supplied to the P-type transistor SM8. The output signal of the second inverter 465 is supplied to gates of the two transistors SM7 and SM8. The second positive voltage SPS2 or the second negative voltage SNS2 are supplied to the gates of two transistors SM7 and SM8 in the second inverter 465 depending on the level of the output signal of the second inverter 465.

The second inverter 465 and the third inverter 463 form a latch in which the inputs and the outputs are connected to each other.

Each of the plurality of holding latches 480 receives a holding control signal EN and an inverted holding control signal ENB from the timing controller 500 and a sampled digital image signal from the sampling latch 460.

One holding latch 480 includes three inverter 481, 483 and 485 and four voltage supply transistors HM1, HM2, HM3 and HM4.

The first voltage supply transistor HM1 is connected to the positive power supply voltage VDD. The first voltage supply transistor HM1 is turned on/off in response to the inverted holding control signal ENB to supply the positive power supply voltage VDD to the first inverter 480.

The second voltage supply transistor HM2 is connected to the negative power supply voltage VSS. The second voltage supply transistor HM2 is turned on/off in response to the holding control signal EN to supply the negative power supply voltage VSS to the first inverter 480.

The third voltage supply transistor HM3 is connected to the positive power supply voltage VDD. The third voltage supply transistor HM3 is turned on/off in response to the holding control signal EN to supply the positive power supply voltage VDD to the second inverter 485.

The fourth voltage supply transistor HM4 is connected to the negative power supply voltage VSS. The fourth voltage supply transistor HM4 is turned on/off in response to the inverted holding control signal ENB to supply the negative power supply voltage VSS to the second inverter 485.

The first and third voltage supply transistors HM1 and HM3 are P-type MOSFETs, and the second and fourth voltage supply transistor HM2 and HM4 are N-type MOSFETs. In other embodiments, the first and third voltage supply transistors HM1 and HM3 may be designed as N-type transistors and the second and fourth voltage supply transistors HM2 and HM4 are designed as P-type transistors according to the level of the holding control signal EN.

The first inverter 481 includes two transistors HM5 and HM6 connected in series. The N-type transistor HM5 is connected to the second voltage supply transistor HM2, and the P-type transistor HM6 is connected to the first voltage supply transistor HM1. In the inverter 480, a sampled one-bit digital image signal from the sampling latch 460 is supplied to gates of the two transistors HM5 and HM6. The first inverter 481 outputs the positive power supply voltage VDD or the negative power supply voltage VSS depending on the level of the sampled one-bit digital image signal.

The second inverter 485 includes two transistors HM9 and HM10 connected in series. The N-type transistor HM9 is connected to the negative power supply voltage VSS, and the P-type transistor HM10 is connected to the positive power supply voltage VDD. The output signal of the first inverter 481 is supplied to gates of the two transistors HM9 and HM10. The second inverter 485 outputs the positive power supply voltage VDD or the negative power supply voltage VSS to the digital/analog converter 450 depending on the level of the output signal of the first inverter 481.

The third inverter 483 includes two transistors HM7 and HM8 connected in series. The N-type transistor HM7 is connected to the fourth voltage supply transistor HM4, and the P-type transistor HM8 is connected to the third voltage supply transistor HM3. The output signal of the second inverter 485 is supplied to gates of the two transistors HM7 and HM8. The third inverter 483 supplies the negative power supply voltage VSS or the positive power supply voltage VDD to the gates of the two transistors HM9 and HM10 of the second inverter 485 depending on the level of the output signal of the second inverter 485.

The second inverter 485 and the third inverter 483 form a latch in which the inputs and the outputs are connected to each other.

The digital/analog converter 450 receives the stored digital image signals from the six holding latches 480, converts the digital image signals into analog voltage values corresponding to gradations represented by a 6-bit digital image signal, and outputs the converted data signal to the data line D1.

Figure 5:
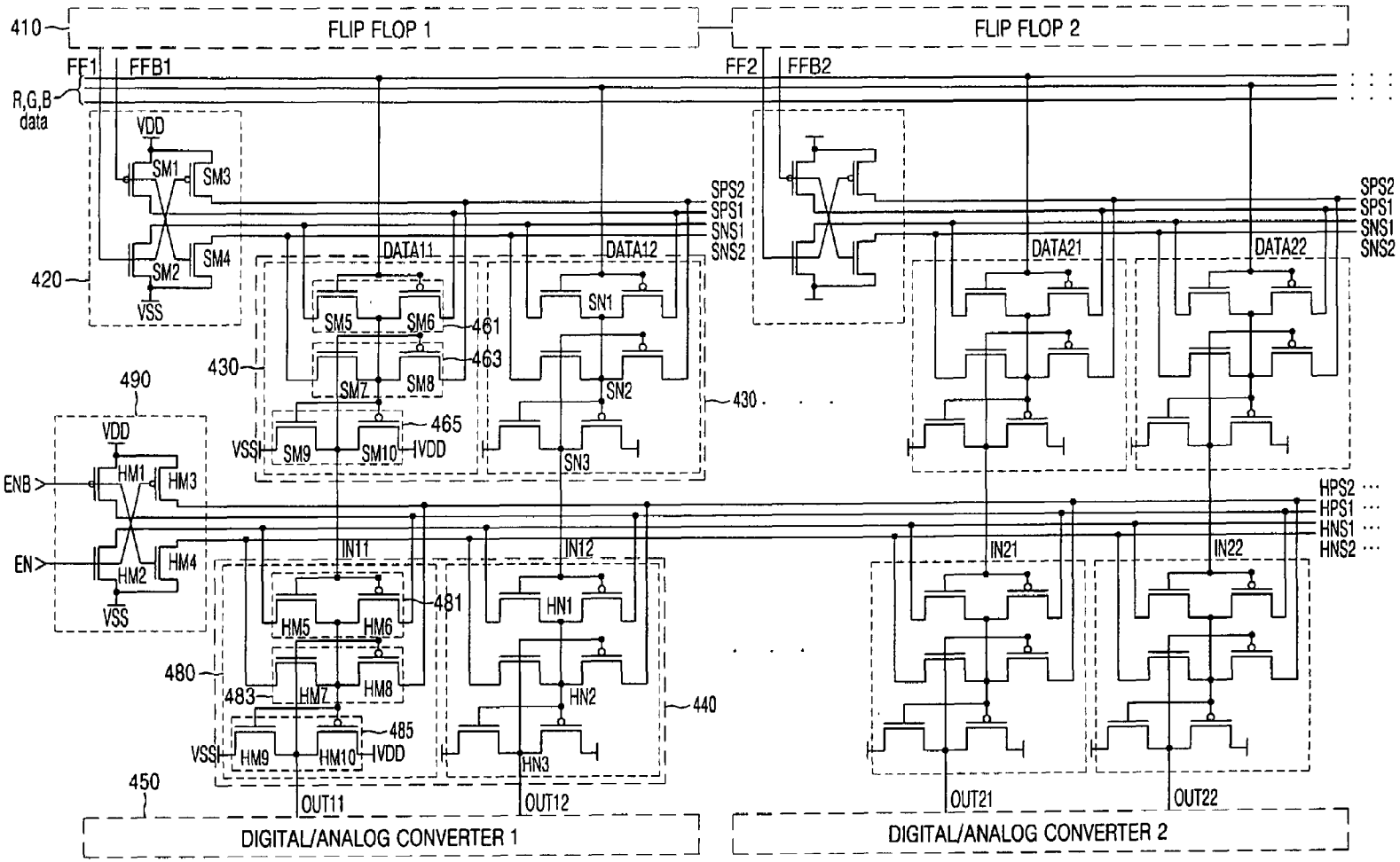
FIG. 5 is a circuit diagram of a data driver according to another embodiment.

FIG. 5 is a circuit diagram of a data driver according to another embodiment.

Referring to FIG. 5, the data driver includes a holding voltage supplying unit 490 for supplying positive and negative voltages HPS and HNS to a plurality of holding latches 480 in common.

In FIG. 5, since a flip flop 410, a sampling voltage supplying unit 420, a sampling latch unit 430, and a digital/analog converter 450 are the same as those shown in FIG. 4, only the holding latch unit 440 and the holding voltage supplying unit 490 will be described.

The holding voltage supplying unit 490 includes four transistors HM1, HM2, HM3 and HM4.

The first transistor HM1 is connected to a positive power supply voltage VDD. The first transistor HM1 is turned on/off in response to an inverted holding control signal ENB received from the timing controller 500 to supply a first positive voltage HPS1 to a plurality of holding latches 480.

The second transistor HM2 is connected to a negative power supply voltage VSS. The second transistor HM2 is turned on/off in response to the holding control signal EN received from the timing controller 500 to supply a first negative voltage HNS1 to the plurality of holding latches 480.

The third transistor HM3 is connected to the positive power supply voltage VDD. The third transistor HM3 is turned on/off in response to the holding control signal EN from the timing controller 500 to supply a second positive voltage HPS2 to the plurality of holding latches 480.

The fourth transistor HM4 is connected to the negative power supply voltage VSS. The fourth transistor HM4 is turned on/off in response to the inverted holding control signal ENB from the timing controller 500 to supply a second negative voltage HNS2 to the plurality of holding latches 480.

The first and third transistors HM1 and HM3 are P-type MOSFETs, and the second and fourth transistors HM2 and HM4 are N-type MOSFETs. However, in some embodiments the first and third transistors HM1 and HM3 are designed as N-type transistors and the second and fourth transistors HM2 and HM4 are designed as P-type transistors according to the level of the holding control signal EN.

As described above, the four transistors HM1, HM2, HM3 and HM4 supply the first positive voltage HPS1, the first negative voltage HNS1, the second positive voltage HPS2, and the second negative voltage HNS2 through connections to the plurality of holding latches 480. The connections couple the respective data driving circuits and to m×6 holding latches 480 formed in m number of data driving circuits in common.

The plurality of holding latches 480 have the same circuit configuration, and one holding latch 480 includes three inverters 481, 483 and 485.

The first inverter 481 includes two transistors HM5 and HM6 connected in series. The N-type transistor HM5 receives the first negative voltage HNS1, and the P-type transistor HM6 receives the first positive voltage HPS1. In the inverter 481, a sampled one-bit digital image signal is supplied to gates of the two transistors HM5 and HM6 through a data transmission line. The first inverter 481 outputs the first positive voltage HPS1 or the first negative voltage HNS1 depending on the level of the sampled digital image signal.

The second inverter 485 includes two transistors HM9 and HM10 connected in series. The N-type transistor HM9 is connected to the negative power supply voltage VSS and the P-type transistor HM10 is connected to the positive power supply voltage VDD. The output signal of the inverter 481 is supplied to gates of the two transistors HM9 and HM10. The second inverter 485 supplies the positive power supply voltage VDD or the negative power supply voltage VSS to the digital/analog converter 450 depending on the level of the output signal of the first inverter 481.

The third inverter 483 includes two transistors HM7 and HM8 connected in series. The second negative voltage HNS2 is supplied to the N-type transistor HM7 and the second positive voltage HPS2 is supplied to the P-type transistor HM8. The output signal of the second inverter 485 is supplied to gates of the two transistors HM7 and HM8. Accordingly, the third inverter 483 supplies the second positive voltage HPS2 or the second negative voltage HNS2 to the gates of the two transistors HM9 and HM10 of the second inverter 485 depending on the level of the output signal of the second inverter 485.

The second inverter 485 and the third inverter 483 form a latch in which inputs and outputs are connected to each other.

The organic light emitting display device having the data driver according to this embodiment in FIG. 5 has substantially the same operation as in the first embodiment in FIG. 3.

Therefore, descriptions of the configuration and operation of the organic light emitting display device having the data driver will be omitted.

The Third Embodiment

Figure 6:
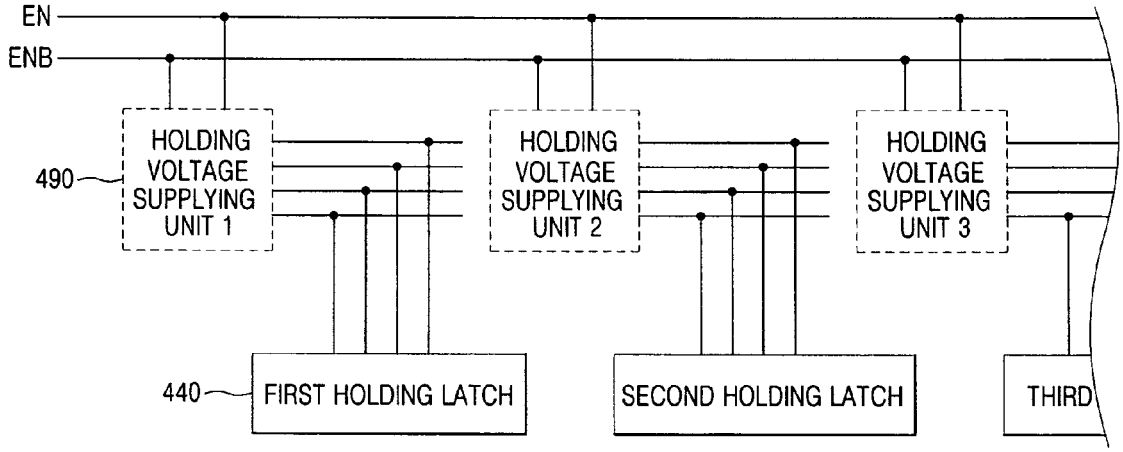
FIG. 6 is a block diagram of a data driver according to yet another embodiment of the present invention.

FIG. 6 is a block diagram of a data driver according to yet another embodiment.

Referring to FIG. 6, the data driver includes a plurality of holding voltage supplying units 490.

The plurality of holding voltage supplying units 490 receive a holding control signal EN and an inverted holding control signal ENB from a timing controller 500 in common, and supply first and second positive power supply voltages and first and second negative power supply voltages to respective holding latches 440.

When power supply voltages are supplied to m×6 holding latches by using one holding voltage supplying unit 490, line resistance may cause a signal delay. For this reason, the plurality of holding voltage supplying units 490 for supplying power supply voltages to a certain number of holding latches may be provided to prevent the signal delay.

The plurality of holding voltage supplying units 490 may be formed in each data driving circuit. Alternatively, the plurality of holding voltage supplying units 490 may be formed per k data driving circuits.

The data driver formed as described above may be formed on a panel where a pixel portion is formed. Similarly, the scan driver or the emission control driver may also be formed on the panel. This configuration implements a system on panel (SOP).

Figure 7:
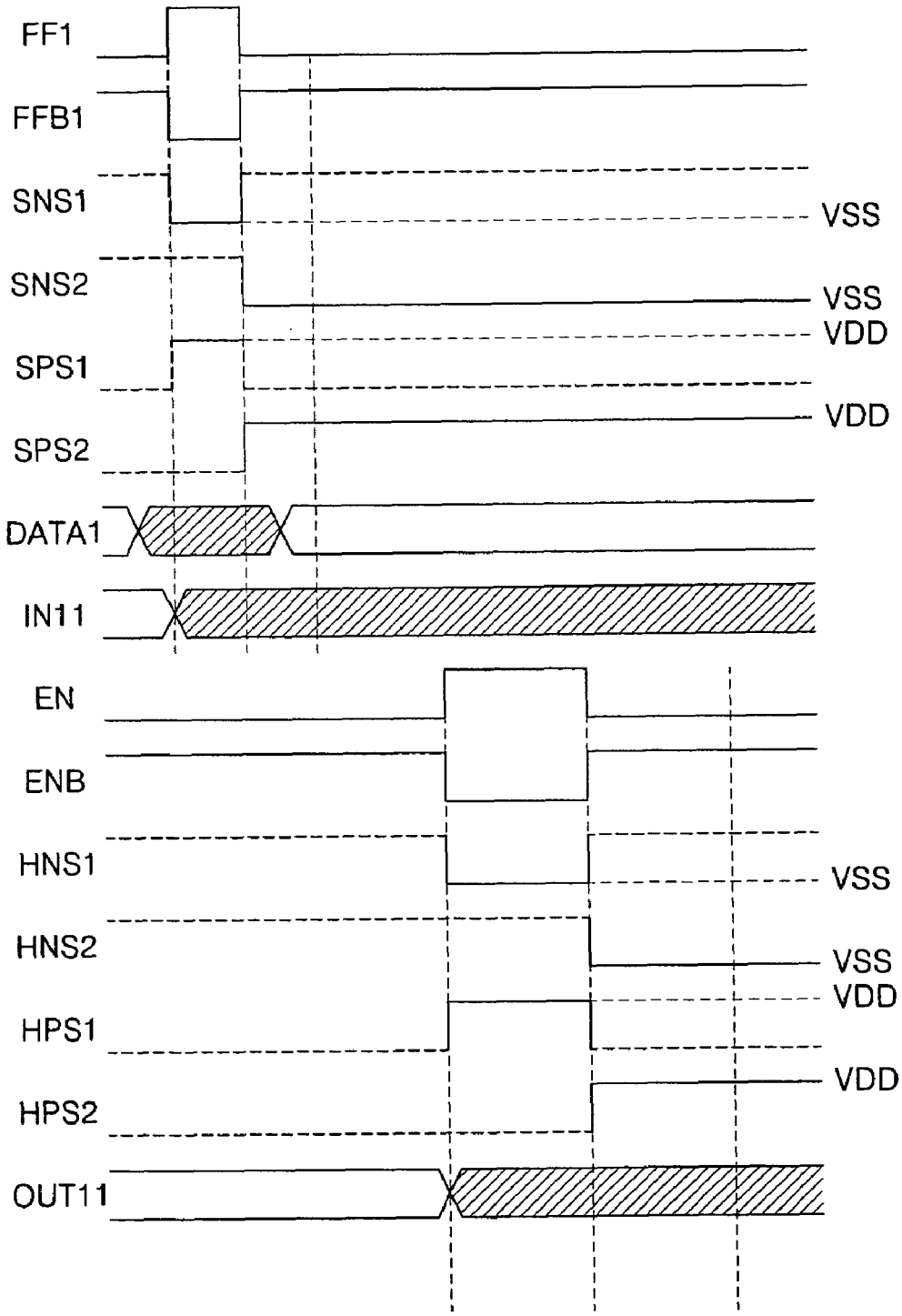
FIG. 7 is a timing diagram illustrating the operation of a data driver according to some embodiments of the present invention.

FIG. 7 is a timing diagram illustrating the operation of a data driver according to some embodiments.

Operation of the data driver of FIGS. 4 and 5 will now be described with reference to FIG. 7.

In FIG. 7, a first sampling latch 460 and a holding latch 480 of a data driving circuit 470, which supplies a data signal to a data line D1, will be described.

When a high-level flip flop output signal FF1 and a low-level inverted flip flop output signal FFB1 are applied to a sampling voltage supplying unit 420, a first transistor SM1 and a second transistor SM2 of the sampling voltage supplying unit 420 are turned on. Accordingly, a first positive voltage SPS1 at a positive power supply voltage VDD level is output to a drain of the first transistor SM1, and a first negative voltage SNS1 at a negative power supply voltage VSS level is output to a drain of the second transistor SM2.

When a digital image signal having a value of 1 is supplied to a first inverter 461 of the first sampling latch 460, an N-type transistor SM5 of the first inverter 461 is turned on and a P-type transistor SM6 is turned off. Accordingly, the first negative voltage SNS1 connected to the N-type transistor SM5 is output to an output SN1 of the first inverter 461. A second inverter 465 receives the first negative voltage SNS1 from the first inverter 461 to turn a P-type transistor SM10 on. Accordingly, the positive power supply voltage VDD connected to the P-type transistor SM10 is output to an output SN3 of the second inverter 465 via the P-type transistor SM10 and transmitted to the holding latch 480. Accordingly, for the digital image signal having the value of 1, the positive power supply voltage VDD is continuously output during a half cycle of the clock.

On the other hand, when a low-level flip flop output signal FF1 and a high-level inverted flip flop output signal FFB1 are supplied to the sampling voltage supplying unit 420, third and fourth transistors SM3 and SM4 of the sampling voltage supplying unit 420 are turned on. Accordingly, a second positive voltage SPS2 at the positive power supply voltage VDD level is output to a drain of the third transistor SM3, and a second negative voltage SNS2 at the negative power supply voltage VSS level is output to a drain of the fourth transistor SM4. Here, since the first and second transistors SM1 and SM2 are turned off, the drains of the first and second transistors SM1 and SM2 are floated and the first positive and negative voltages SPS1 and SNS1 are not output.

Accordingly, the third and fourth transistors SM3 and SM4 output a positive voltage SPS and a negative voltage SNS shifted in time by a half cycle of the clock of the flip flop 410 with respect to the first and second transistors SM1 and SM2.

The sampling latch 460 operates irrespective of change in the digital image signal since the first positive voltage SPS1 and the first negative voltage SNS1 are not supplied to the first inverter 461.

The positive power supply voltage VDD, which is a previous output signal of the second inverter 465, is applied to a third inverter 463. Accordingly, an N-type transistor SM7 of the third inverter 463 is turned on and the second negative voltage SNS2 connected to the N-type transistor SM7 is supplied to the second inverter 465 via the N-type transistor SM7. The second inverter 465 receives the second negative voltage SNS2 from the third inverter 463 to turn the P-type transistor SM10 on and outputs to holding latch 480 an output signal corresponding to the positive power supply voltage VDD.

The latch operation of the second inverter 465 and the third inverter 463 continues until the flip flop output signal FF1 becomes at a high level and a new digital image signal is received from the first inverter 461. Accordingly, the sampling latch 460 continues to output an output signal at the positive power supply voltage VDD level until m number of flip flops 410 sequentially output an output signal.

When a high-level output signal FF1 is output to m-th flip flop 410 and m×6 sampling latches 460 output a sampled digital image signal, a high-level holding control signal EN and a high-level inverted holding control signal ENB are simultaneously supplied from the timing controller 500 to the m×6 holding latches 480 in FIG. 4.

Operation of the first holding latch 480 will now be described. A low-level inverted holding control signal ENB is applied to a first voltage supply transistor HM1, and a high-level holding control signal EN is applied to a second voltage supply transistor HM2. Further, an output signal at the positive power supply voltage VDD level is supplied to gates of two transistors HM5 and HM6 of a first inverter 481. Accordingly, the first and second voltage supply transistors HM1 and HM2 and an N-type transistor HM5 of the first inverter 481 are turned on, and the first inverter 481 outputs the negative power supply voltage VSS. When the negative power supply voltage VSS is applied to two transistors HM9 and HM10 of a second inverter 485, the P-type transistor HM10 is turned on. Accordingly, the second inverter 485 outputs an output signal OUT11 at the positive power supply voltage VDD level to a digital/analog converter 450.

When a low-level holding control signal EN and a high-level inverted holding control signal ENB are supplied from the timing controller 500, the first and second voltage supply transistors HM1 and HM2 are turned off and the third and fourth voltage supply transistors HM3 and HM4 are turned on. Further, the positive power supply voltage VDD, which is the previous output signal of the second inverter 485, is supplied to gates of two transistors HM7 and HM8 of a third inverter 483, and the N-type transistor HM7 is turned on. Accordingly, the negative power supply voltage VSS is applied to the gates of the two transistors HM9 and HM10 of the second inverter 485 via the fourth voltage supply transistor HM4 and the N-type transistor HM7. Accordingly, the P-type transistor HM10 of the second inverter 485 is turned on and the positive power supply voltage VDD is output to the digital/analog converter 450. Such operation continues when the high holding control signal EN is supplied from the timing controller 500 in a next horizontal synchronization period.

When a high-level output signal FFm is output to the m-th flip flop 410 and all the m×6 sampling latches 460 output a sampled digital image signal, a high-level holding control signal EN and a low-level inverted holding control signal ENB are supplied from the timing controller 500 to the holding voltage supplying unit 490 in FIG. 5.

When the high-level holding control signal EN and the low-level inverted holding control signal ENB are applied to the holding voltage supplying unit 490, the first and second transistors HM1 and HM2 of the holding voltage supplying unit 490 are turned on. Accordingly, a first positive voltage HPS1 at the positive power supply voltage VDD level is output to a drain of the first transistor HM1, and a first negative voltage HNS1 at the negative power supply voltage VSS level is output to a drain of the second transistor HM2.

At this time, when a sampled digital image signal at the positive power supply voltage VDD level is supplied to the first inverter 481 of the first holding latch 480, the N-type transistor HM5 of the first inverter 481 is turned on and the P-type transistor HM6 is turned off. Accordingly, the first negative voltage HNS1 supplied to the N-type transistor HM5 is output from the first inverter 481. The second inverter 485 receives the first negative voltage HNS1 from the first inverter 481 to turn the P-type transistor HM10 on. Accordingly, the positive power supply voltage VDD connected to the P-type transistor HM10 is transmitted from the second inverter 485 to the digital/analog converter 450.

On the other hand, when a low-level holding control signal EN and a high-level inverted holding control signal ENB are supplied to the holding voltage supplying unit 490, the third and fourth transistors HM3 and HM4 of the holding voltage supplying unit 490 are turned on. Accordingly, a second positive voltage HPS2 at the positive power supply voltage VDD level is output to a drain of the third transistor HM3, and a second negative voltage HNS2 at the negative power supply voltage VSS level is output to a drain of the fourth transistor HM4. Here, since the first and second transistors HM1 and HM2 are turned off, the drains of the first and second transistors HM1 and HM2 are floated and the first positive and negative voltages HPS1 and HNS1 are not output.

Accordingly, the third and fourth transistors HM3 and HM4 output positive and negative voltages HPS and HNS shifted in time by a half cycle of the holding control signal EN with respect to the first and second transistors HM1 and HM2.

The holding latch 480 operates irrespective of change in the output signal IN11 of the sampling latch 460 since the first positive and negative voltages HPS1 and HNS1 are not supplied to the first inverter 481.

The positive power supply voltage VDD, which is a previous output signal of the second inverter 485, is applied to the third inverter 483. Accordingly, the N-type transistor HM7 of the third inverter 483 is turned on and the second negative voltage HNS2 connected to the N-type transistor HM7 is supplied to the second inverter 485 via the N-type transistor HM7. The second inverter 485 receives the second negative voltage HNS2 from the third inverter 483 to turn the P-type transistor HM10 on and outputs to the digital/analog converter 450 an output signal OUT11 corresponding to the positive power supply voltage VDD.

The latch operation of the second inverter 485 and the third inverter 483 continues until the high-level holding control signal EN is supplied from the timing controller 500.

When a plurality of holding voltage supplying units 490 are formed as shown in FIG. 6, the above-described operation of the holding voltage supplying unit 490 is substantially simultaneously performed in response to the holding control signal EN and the inverted holding control signal ENB from the timing controller 500.

According to embodiments described above, the data driver having a plurality of sampling latches and holding latches includes a sampling voltage supplying unit for receiving a flip flop output signal and supplying a power supply voltage to the plurality of sampling latches. Accordingly, it is possible to significantly reduce the number of transistors constituting the sampling latches and reduce the area of the driver. It is also possible to reduce power consumption due to the reduced number of transistors of the sampling latches.

Although the present invention has been described with reference to certain embodiments thereof, changes may be made to the described embodiments without departing from the scope of the present invention.

What is claimed is:

1. A data driver comprising:

a shift register configured to receive a start pulse and to sequentially generate at least one output signal in synchronization with a clock signal;

a plurality of sampling latches configured to receive a digital image signal and to sample the received digital image signal;

a plurality of holding latches configured to receive and to store the sampled digital image signal;

a digital/analog converter configured to receive the stored digital image signal from the plurality of holding latches and to convert the stored digital image signal into an analog data signal; and a sampling voltage supplying unit configured to receive the output signal and the inverted output signal of the shift register, to generate a sampling voltage, and to supply the sampling voltage to each of the plurality of sampling latches, wherein the sampling voltage supplying unit comprises:

a first switching unit configured to receive the output signal and the inverted output signal of the shift register and to generate a plurality of positive voltages; and a second switching unit configured to receive the output signal and the inverted output signal of the shift register and to generate a plurality of negative voltages.

2. The data driver according to claim 1, wherein the first switching unit comprises:

a first transistor connected to a positive power supply voltage and configured to be turned on and turned off in response to the output signal of the shift register so as to conditionally output the first positive voltage; and a second transistor connected to the positive power supply voltage and configured to be turned on and turned off in response to the inverted output signal of the shift register so as to conditionally output the second positive voltage.

3. The data driver according to claim 2, wherein the second switching unit comprises:

a third transistor connected to a negative power supply voltage and configured to be turned on and turned off in response to the output signal of the shift register so as to conditionally output the first negative voltage; and a fourth transistor connected to the negative power supply voltage and configured to be turned on and turned off in response to the inverted output signal of the shift register so as to output the second negative voltage.

4. The data driver according to claim 3, wherein the first and second transistors of the first switching unit have a conductivity type different from that of the third and fourth transistors of the second switching unit.

5. The data driver according to claim 4, wherein the second positive and second negative voltages are delayed in time by a half cycle of the clock signal of the shift register with respect to the first positive and first negative voltages.

6. The data driver according to claim 5, wherein the sampling latch comprises:

a first inverter configured to receive the digital image signal and to generate a first inverter output signal in response to the received digital image signal, wherein the first inverter output signal is either the first positive voltage or the first negative voltage;

a second inverter configured to receive the first inverter output signal and to generate a second inverter output signal; and a third inverter configured to receive the second inverter output signal and to output a third inverter output signal, wherein the third inverter output signal is either the second positive voltage or the second negative voltage and the third inverter is further configured to apply the third inverter output signal to the second inverter.

7. The data driver according to claim 6, wherein the plurality of holding latches substantially simultaneously receive a holding control signal and an inverted holding control signal and supply the stored digital image signal to the digital/analog converter.

8. An organic light emitting display device comprising:

a pixel portion configured to display an image;

a scan driver configured to supply a scan signal to the pixel portion;

a data driver configured to supply a data signal to the pixel portion; and a timing controller configured to supply a control signal and a digital image signal to the scan driver and the data driver, wherein: the data driver comprises:

a shift register configured to receive a start pulse and to sequentially generate output and inverted output signals in synchronization with a clock signal;

a plurality of sampling latches configured to receive a digital image signal and to sample the received digital image signal;

a plurality of holding latches configured to receive and to store the sampled digital image signal;

a digital/analog converter configured to receive the stored digital image signal from the plurality of holding latches and to convert the stored digital image signal into an analog data signal; and a sampling voltage supplying unit configured to receive the output signal and the inverted output signal of the shift register, to generate a sampling voltage, and to supply the sampling voltage to each of the plurality of sampling latches, wherein the sampling voltage supplying unit comprises:

a first switching unit configured to receive the output signal and the inverted output signal of the shift register and to generate first and second positive voltages; and a second switching unit configured to receive the output signal and the inverted output signal of the shift register and to generate first and second negative voltages.

9. The organic light emitting display device according to claim 8, wherein the first switching unit comprises:

a first transistor connected to a positive power supply voltage and configured to be turned on and turned off in response to the output signal of the shift register so as to conditionally output the first positive voltage; and a second transistor connected to the positive power supply voltage and configured to be turned on and turned off in response to the inverted output signal of the shift register so as to conditionally output the second positive voltage.

10. The organic light emitting display device according to claim 9, wherein the second switching unit comprises:

a third transistor connected to a negative power supply voltage and configured to be turned on and turned off in response to the output signal of the shift register so as to conditionally output the first negative voltage; and a fourth transistor connected to the negative power supply voltage and configured to be turned on and turned off in response to the inverted output signal of the shift register so as to output the second negative voltage.

11. The organic light emitting display device according to claim 10, wherein the first and second transistors of the first switching unit have a conductivity type different from that of the third and fourth transistors of the second switching unit.

12. The organic light emitting display device according to claim 11, wherein the second positive and second negative voltages are delayed in time by a half cycle of the clock signal of the shift register with respect to the first positive and first negative voltages.

13. The organic light emitting display device according to claim 12, wherein the sampling latch comprises:

a first inverter configured to receive the digital image signal from the timing controller and to generate a first inverter output signal in response to the received digital image signal, wherein the first inverter output signal is either the first positive voltage or the first negative voltage; and a latch unit configured to receive and to store the first inverter output signal, and to output a latch unit output signal to one of the holding latches.

14. The organic light emitting display device according to claim 13, wherein the latch unit comprises:

a second inverter configured to receive the first inverter output signal and to generate a second inverter output signal; and a third inverter configured to receive the second inverter output signal and to output a third inverter output signal, wherein the third inverter output signal is either the second positive voltage or the second negative voltage and the third inverter is further configured to apply the third inverter output signal to the second inverter.

15. The organic light emitting display device according to claim 14, wherein the plurality of holding latches substantially simultaneously receive a holding control signal and an inverted holding control signal from the timing controller and supply the stored digital image signal to the digital/analog converter.

16. The organic light emitting display device according to claim 14, further comprising a holding voltage supplying unit configured to receive a holding control signal and an inverted holding control signal from the timing controller, to generate a plurality of holding voltages, and to substantially simultaneously supply the holding voltages to the plurality of holding latches.

17. The organic light emitting display device according to claim 14, further comprising a plurality of holding voltage supplying units configured to receive a holding control signal and an inverted holding control signal from the timing controller, to generate a plurality of holding voltages, and to substantially simultaneously supply the holding voltages to the plurality of holding latches.

18. The organic light emitting display device according to claim 14, wherein the pixel portion, the scan driver, and the data driver are formed on the same substrate.

19. The organic light emitting display device according to claim 15, wherein the pixel portion, the scan driver, and the data driver are formed on the same substrate.

20. The organic light emitting display device according to claim 16, wherein the pixel portion, the scan driver, and the data driver are formed on the same substrate.

21. The organic light emitting display device according to claim 17, wherein the pixel portion, the scan driver, and the data driver are formed on the same substrate.

* * * * *